US007358460B2

(12) United States Patent
Hoffman et al.

(10) Patent No.: US 7,358,460 B2
(45) Date of Patent: Apr. 15, 2008

(54) DEPLOYMENT SYSTEM FOR THERMAL RADIATING MATERIALS

(76) Inventors: William H. Hoffman, 2510 E. 50th St. Apt. 1, Davenport, IA (US) 57807; Sandra R. Ruhl, 2510 E. 50th St. Apt, Davenport, IA (US) 52807

( * ) Notice: Subject to any disclaimer, the term of this patent is extended or adjusted under 35 U.S.C. 154(b) by 222 days.

(21) Appl. No.: 11/315,405

(22) Filed: Dec. 22, 2005

(65) Prior Publication Data

US 2006/0155443 A1 Jul. 13, 2006

Related U.S. Application Data

(60) Provisional application No. 60/638,662, filed on Dec. 22, 2004.

(51) Int. Cl.
*H05B 1/00* (2006.01)

(52) U.S. Cl. ..... 219/213; 219/528; 219/536; 219/538; 219/549

(58) Field of Classification Search ..... 219/213, 219/528, 549, 541, 536, 548; 156/433
See application file for complete search history.

(56) References Cited

U.S. PATENT DOCUMENTS 3,964,959 A * 6/1976 Adams ..... 156/433
4,646,818 A 3/1987 Ervin, Jr.
4,967,057 A 10/1990 Bayless
5,003,157 A 3/1991 Hargrove
5,143,325 A 9/1992 Zieve
5,229,583 A * 7/1993 van Egmond et al. ..... 219/549
5,291,000 A 3/1994 Hornberger
5,380,988 A 1/1995 Dyer
5,395,179 A 3/1995 Kotani
5,591,365 A * 1/1997 Shields ..... 219/213
5,605,418 A 2/1997 Watanabe
5,637,247 A * 6/1997 Flynn, Jr. ..... 219/213
5,676,563 A 10/1997 Kondo
5,710,408 A 1/1998 Jones
5,763,858 A 6/1998 Jones
5,854,470 A 12/1998 Silva
5,890,324 A 4/1999 Maanum
5,900,178 A 5/1999 Johnsen
5,966,502 A 10/1999 Pearce
6,051,811 A * 4/2000 Hardison ..... 219/213
6,051,812 A * 4/2000 Walker ..... 219/213
6,166,352 A * 12/2000 Turton ..... 219/213
6,180,929 B1 1/2001 Pearce
6,184,496 B1 2/2001 Pearce
6,278,085 B1 8/2001 Abukasm (Continued)

*Primary Examiner*—Robin Evans
*Assistant Examiner*—Leonid M. Fastovsky
(74) *Attorney, Agent, or Firm*—John E. Cepican

(57) ABSTRACT

An autonomous deployment system is herein for functional utilization in the physical placement and deployment of a heating or thermal mat(s). The system is designed to enhance human productivity and ease deployment of the prior art thermal radiating or generating devices for the removal and or inhibition of accumulation of snow and ice. The deployment system as can be designed to operate autonomously with automatic controls and sensors to control both the thermal system and the technology of controlling a deployment system. The system is well suited to autonomously deploy and retract rolled membranes and or flexible materials out over a flat or sloped surface area. The inherent flexibility of the mat allows it to traverse gently curved surfaces.

28 Claims, 31 Drawing Sheets
(16 of 31 Drawing Sheet(s) Filed in Color)

U.S. PATENT DOCUMENTS 6,479,797 B1 11/2002 Yanagimoto
6,664,521 B1 12/2003 Kondo
6,908,444 B2 * 6/2005 Lindh et al. ..... 602/7
2006/0086717 A1 * 4/2006 Oosterling ..... 219/528

* cited by examiner

DEPLOYMENT SYSTEM FOR THERMAL RADIATING MATERIALS

CROSS REFERENCE TO RELATED APPLICATIONS

Applicant herein claims priority from and incorporates herein by reference in its entirety provisional patent application filed on Dec. 22, 2004 and assigned Ser. No. 60,638,662.

FIELD OF THE INVENTION

This invention relates to a deployment apparatus and system used for melting snow using thermal radiating flexible mat-type systems. Elements disclosed and claimed also include a novel deployment system as well as the storage of the thermal radiating systems.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable

BACKGROUND OF THE INVENTION

The prior art describes a multitude of thermal mat designs, construction and features such as type of heating systems (dry or wet) applied, multiple materials for flexibility and durability, mat designs, and even modular semi-ridged panels. The prior art in this field also describes electrical controls for turning mats on and off.

As found in the prior art, the individual must physically layout the mats and or modular panels either during or before snowfall and or icing conditions. Some can be left out in the adverse weather and can even be driven over by automobiles. Other mat systems allow for people to walk on them when in use although this clearly subjects the mat systems to increased wear and tear and other environmental stresses.

Another variation found in the prior art is to embed and or submerge the heating elements directly in the base materials and or overlays that are used to manufacture the surfaces of roads, walk ways, arenas, roofs, floors and so on. See for example U.S. Pat. No. 5,395,179 issued to Kotani, U.S. Pat. No. 5,605,418 issued to Watanabe and U.S. Pat. No. 6,479,797 issued to Yanagimoto. This type of deployment also has disadvantages. For example, if the surface material cracks from normal seasonal variations or use, the embedded coils or element may also break requiring expensive repairs to the thermal elements for repair. By having to rip up or tear apart the expensive surface materials to expose the thermal element needed to be repaired.

Another form of thermal generation found in the prior art is through the use of electromagnetic waves to produce heat and or repel snow and ice bonding to surfaces. This process is typically called induction. Induction of an electromagnetic field produced by current flow causes a thermal heating of the affected area. This is accomplished by EMF (electromagnetic field) that generates a field that excites electrons to produce heat. This process can under proper conditions negate the molecular attraction produce by ice that allows it to bond with matter. This process though limited at this time to such things as steel rails, and power lines, may in the future need a deployment system, to apply its effects via a blanket or mat type design.

To date nothing has been designed and or patented in the deployment and storage of these mat designs that does not require the intervention of great amounts of human manpower to deploy and store these devices. Manual deployment may be very difficult for most people but is especially difficult for the aged, weak and sickly. Many times these people most need the advantages provided by a heating mat snow removal system to clear sidewalks and driveways of snow and ice. Additionally, the aesthetics of these unsightly mats lain across sidewalks and driveways can be an eye sore and a trip hazard. For additional background, see U.S. Pat. No. 4,967,057 issued to Bayless; U.S. Pat. No. 5,003,157 issued to Hargrove; U.S. Pat. No. 5,291,000 issued to Hornberger; U.S. Pat. No. 5,591,365 issued to Sheilds; U.S. Pat. No. 5,854,470 issued to Silva; U.S. Pat. No. 6,051,811 issued to Hardis; and U.S. Pat. No. 6,148,496 issued to Pearce herein incorporated by reference.

Manually deployed mat styles found in the prior art have numerous limitations in deployment, such as in remote areas to which it is hard to get delivery personnel and equipment. These areas could be but are not limited to parking areas in remote locations, bridges, highway over passes, sports fields and arenas, and any area where it would be desirable to have an ice and snow free surface.

SUMMARY OF THE INVENTION

The autonomous deployment system described and disclosed herein is designed to functionally utilize and maximize the storage capabilities and application possibilities while at the same time addressing the structural limitations and architectural limitations of the prior art in the physical placement and deployment of a heating or thermal mat.

The invention is designed as such, to enhance the human productivity and ease human interaction in deployment of the prior art thermal radiating or generating devices for the removal or destruction of snow and ice in a special and unique way. The deployment system as disclosed and claimed can be designed to operate autonomously with automatic controls and sensors to control both the thermal system and the technology of controlling a deployment system as defined by my invention. The invention is well suited to autonomously deploy and retract rolled membranes and or flexible materials out over a flat or gently sloped surface area. The inherent flexibility of the mat allows it to traverse gently curved surfaces. This invention improves upon the deployment and storage of the multitude of snow melting devices available in the market. The invention as disclosed allows for easy deployment and storage in a wide range of applications. It is generally understood in the prior art, that the easy placement of a heating element, mat, tile, sheet is desirable. This invention relieves the human being from having to strenuously participate in the deployment and storage of this material. It is therefore an object of this invention to provide an autonomous deployment system for flexible thermal radiating materials that is easy for a human to use and requires minimal manual efforts.

It is an object of the invention to provide an autonomous deployment system for flexible thermal radiating materials that is corrosion resistant.

It is an object that of said system to use sensors and automated controls for automation of deployment and the temperature control of the thermal radiating materials.

It is another object of said invention that included tracks and drivers for deployment of the thermal radiating materials.

It is another object of said track and driver system that it be self-clearing or cleaning to improve its reliability.

It is another object of the invention that the deployment system use an equal or balanced tension deployment to reduce the input energy required to deploy said system.

It is another object of the invention to teach and claim a spool actuated drive system for deployment of the heating materials.

It is another object of the invention that the deployment system use a bi-relational drive system to further reduce the input energy required to deploy said system.

It is another object of the invention to teach and claim a spool actuated drive system for deployment of the heating materials.

It is another object of the invention that the deployment system use a bi-relational drive system to further reduce the input energy required to deploy said system.

It is another object of the invention that the deployment system use a bi-directional torque applier drive system to improve the reliability and further reduce the input energy required to deploy said system.

It is another object of the invention that the deployment system be designed for either portability or permanent installation.

It is another object of the invention that the deployment system be adaptable to various applications requiring an autonomous deployment system.

It is another object of the invention that the deployment system be designed to be resistant to corrosive liquids or substances to which the system may be subjected.

It is another object of the invention that the deployment system be adaptable to various applications requiring an autonomous deployment system.

It is another object of the invention that the deployment system be adapted for remote bridge retrofits for ice and or snow removal.

It is another object of the invention that the deployment system be adapted for remote walkways and surface areas for ice and or snow removal.

It is another object of the invention that the deployment system is adaptable to remote or partially inaccessible areas such as sports fields, parking lots, roofs of buildings, run ways, and any areas require snow or ice removal.

These and other objects of the invention will become apparent to one of ordinary skill in the art after reading the disclosure of the invention.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

DETAILED DESCRIPTION—ELEMENT LISTING

Figure 1:
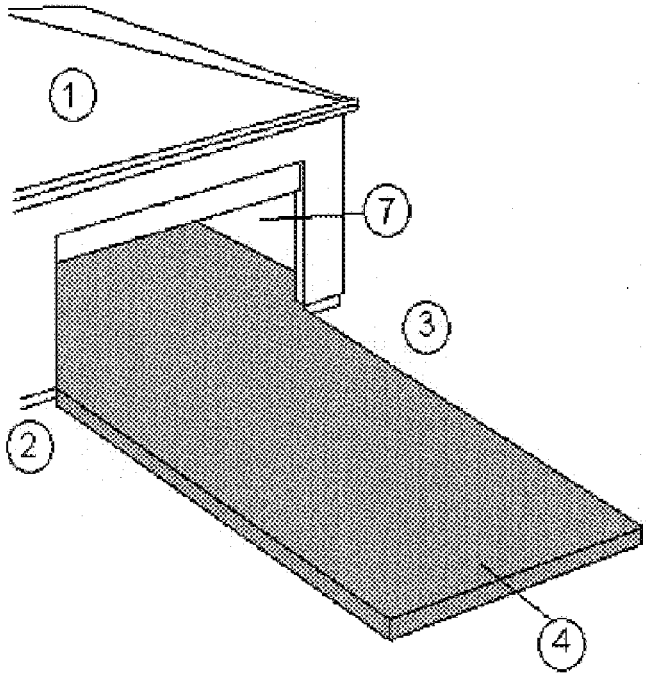
FIG. 1 illustrates a typical driveway wherein the invention may be applied.

| Listing of Elements | Element # |
|---|---|
| Building or structure | 1 |
| Support surface | 2 |
| Deployment unit power source | 3 |
| Driveway surface area | 4 |
| Flexible thermal mat (material) | 5 |
| Anchoring spike | 6 |
| Open bay | 7 |
| Track and rail assembly | 8 |
| Thermal mat 5 one-half deployed | 9 |
| Thermal mat 5 three-quarters deployed | 10 |
| Thermal mat 5 fully deployed | 11 |
| Track & rail assembly end cap | 12 |
| Idler block assembly | 13 |
| Drive cable | 14 |
| Idler | 15 |
| External sensor collection pod | 16 |
| Cable guide tube | 17 |
| Drive shaft bushing | 18 |
| Environment sensor | 19 |
| Thermal mat roller axle | 20 |
| Thermal mat roller axle | 21 |
| Cable drive clamping tube assembly | 22 |
| Compression screws | 23 |
| Cable tube guide | 24 |
| Clamping tube assembly beveled surfaces | 25 |
| Programmable logic controller | 26 |
| Thermal mat anchoring point | 27 |
| Thermal mat drive axle bushing and axle mounting slot | 28 |
| Thermal mat spool axle bushing and axle mounting slot | 29 |
| Deployment system housing | 30 |
| Housing re-enforcement rib or support | 31 |
| Threaded adjusting bolt | 32 |
| Idler plate tongue | 33 |
| Drive cable idler stop foot | 34 |
| Adjusting bolt lock nut | 35 |
| Deployment system control panel | 36 |
| Drive shaft drive pulley | 37 |
| Roller storage shaft bushing | 38 |
| Drive axle shaft protective coating | 39 |
| Powered drive axle | 40 |
| Cable deployment spool assembly | 41 |
| Cable retraction spool assembly | 42 |
| Roller storage shaft | 43 |
| Cable drive axle assembly and thermal mat roller axle assembly | 44 |
| Electric drive motor | 45 |
| Cable fastener attachment assembly | 46 |
| Child guard safety torque sensor | 47 |
| Thermal mat roller axle drive pulley | 48 |
| Power source | 49 |
| Portable configuration assembly towing clamp or lock | 50 |
| Data input panel | 51 |
| Fully submerged configuration | 52 |
| Semi-submerged configuration | 53 |
| Sensor Indicator panel | 54 |
| Deployment System | 55 |
| Deployment System Override | 56 |
| Open | 57 |
| Anchoring spike baffle | 58 |
| Anchoring spike fastener | 59 |
| PCMCIA card slot | 60 |
| Phone/Internet connection | 61 |
| LCD screen | 62 |
| Open | 63–67 |

-continued

| Listing of Elements | Element # |
|---|---|
| Retractable deployment cover | 68 |
| Open | 69 |
| Automatic hatch assembly | 70 |
| Track and rail port | 71 |
| Open | 72 |
| Cover seal | 73 |
| Open | 74 |
| Slip hinge | 75 |
| Pump | 76 |
| Ground fault interrupter (GFI) circuit type heater | 77 |
| Sump pump-mounting porthole | 78 |
| Cable deployment driver | 79 |
| Cable deployment driver idler | 80 |
| Mat deployment roller idler | 81 |
| Thermal mat roller | 82 |
| Rail system | 83 |
| Thermal mat roller system | 84 |
| Cable driven mat deployment system | 85 |
| Open | 86–88 |
| Groove in track | 89 |
| Open | 90 |
| Portable configuration cart | 91 |
| Open | 92 |
| Cable wedge block cable portal | 93 |
| Set screw | 94 |
| Cable wedge block assembly | 95 |
| Securing wedge port | 96 |
| Cable directional spool reel | 97 |

DETAILED DESCRIPTION

FIG. 1 illustrates a pre-existing driveway area 4 prior to treatment with flexible heating mats without the deployment system 55 (FIG. 3) installed. In typical applications, the driveway 4 may be directly in front of the garage door or open bay 7 of the building or structure 1.

Figure 2:
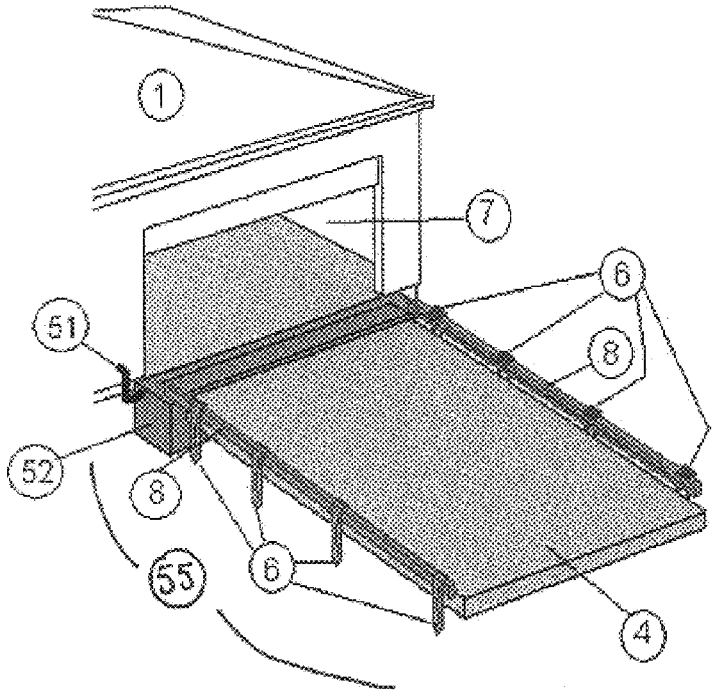
FIG. 2 illustrates overview of the deployment installed and ready for use.

FIG. 2 illustrates the deployment system 55 as deployed in front of a building or structure 1. The deployment system 55 surrounds the driveway or area to be treated 4. The track and rail assembly 8 of the deployment system 55 is placed in close proximity to the opening or bay of the building 7 and affixed permanently with anchoring spike 6. The waterproof power and control sensor cable harness 51 provides power and control signals to the deployment system 5. As shown and installed, the waterproof and corrosion proof deployment system housing 30 (FIG. 8) is in the fully submerged configuration. The system housing 30 may be driven or walked over when fully submerged.

Figure 3:
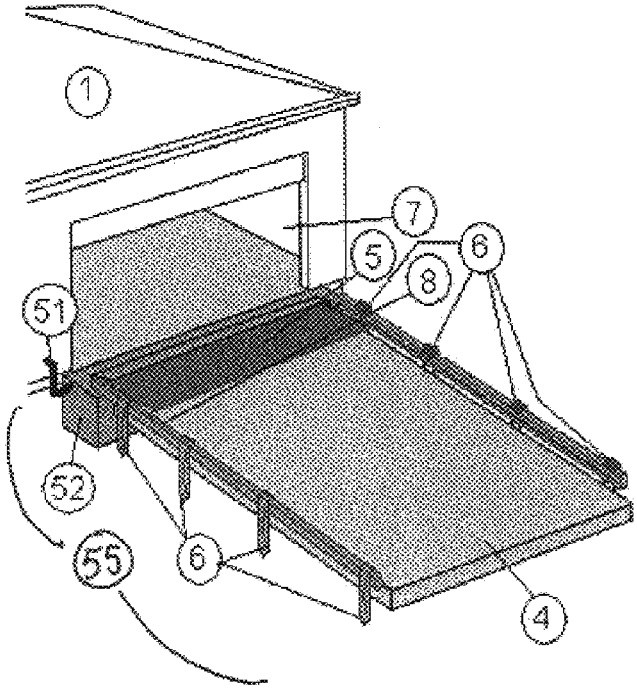
FIG. 3 illustrates the deployment system one-quarter deployed.
Figure 4:
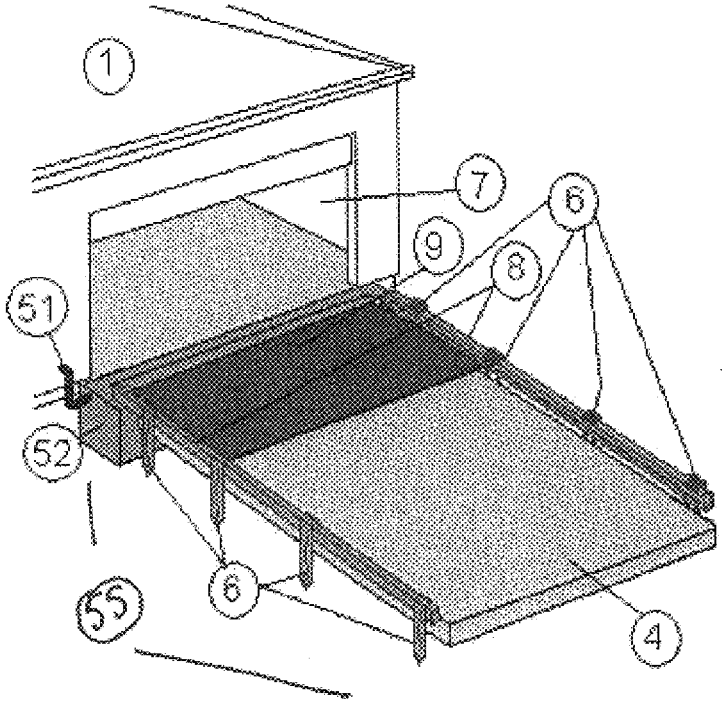
FIG. 4 illustrates the deployment system one-half deployed.
Figure 5:
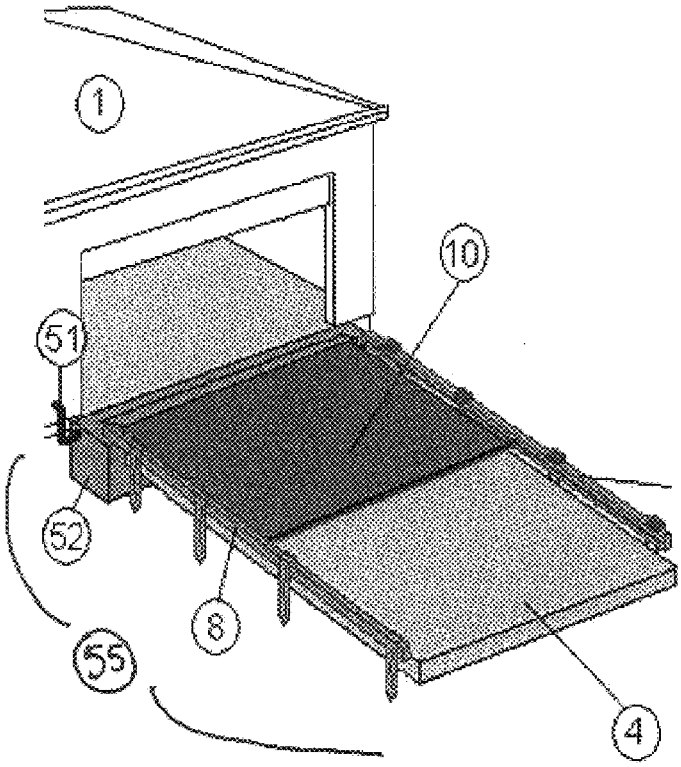
FIG. 5 illustrates the deployment system three-quarter deployed.
Figure 6:
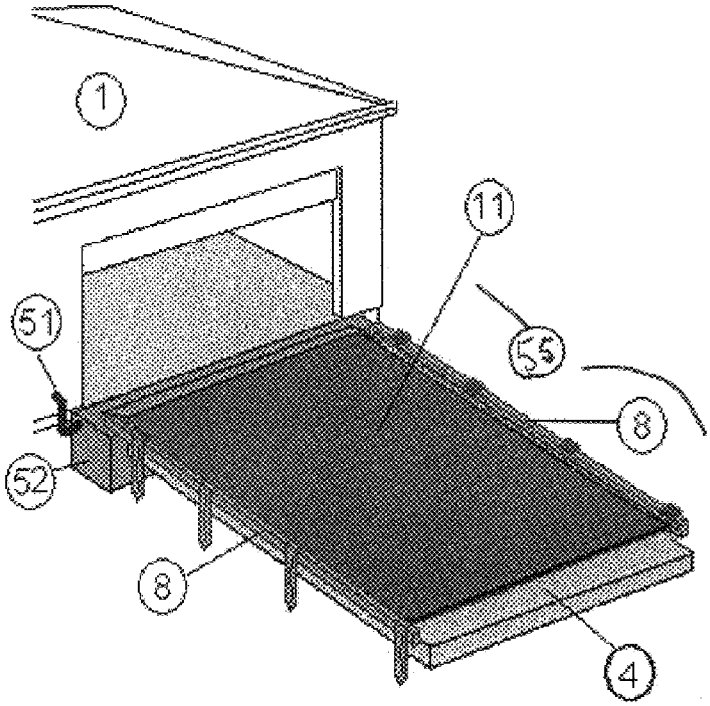
FIG. 6 illustrates the deployment system fully deployed.

FIGS. 3–6 show the deployment in action. FIG. 3 shows the flexible thermal mat 5 at the start or initiation of deployment by the deployment system 55. FIG. 4 shows the flexible thermal mat 5 at the ¼ deployment mark, as indicated by the arrow labeled 9. FIG. 5 shows the thermal mat 5 mid-phase and FIG. 6 shows the flexible thermal mat 5 fully deployed upon the driveway or other surface to be treated 4, as respectively indicated at arrows 10 and 11.

Figure 7:
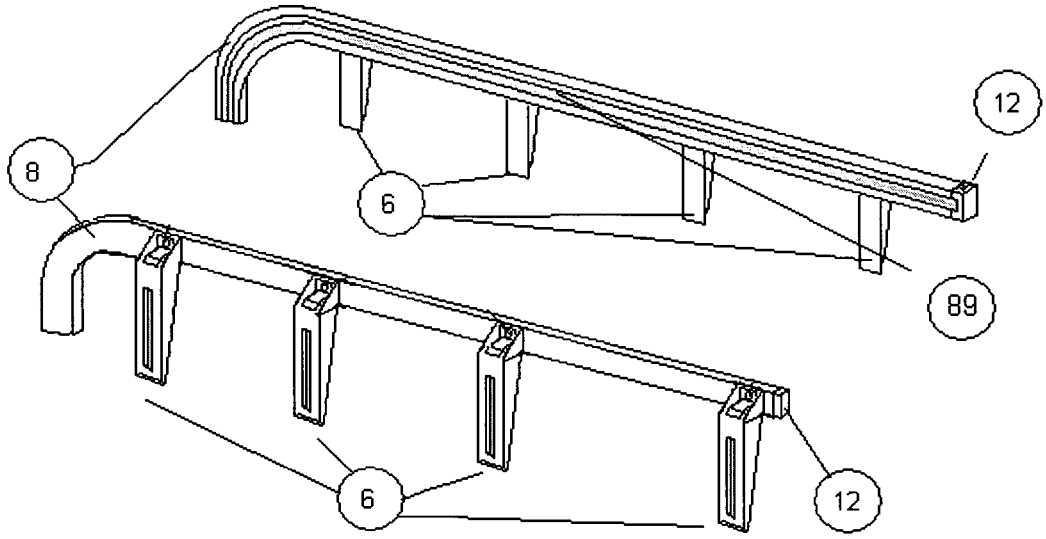
FIG. 7 illustrates the subcomponent track and rail assembly.

FIG. 7 shows an exploded view of the track and rail assembly 8 used by the deployment system 55. Anchoring spike 6 is positioned in the support surface 2 adjacent to the area to be treated 4 and serves to affix the track and rail assembly 8 over the surface to be treated 4. The track & rail assembly 8 contains an open track, slot or groove 89 to support the flexible mat 5. The track & rail assembly end cap 12 ensures the flexible mat 5 cannot go past the ends of the track and rail assembly 8. The track and rail assembly 8 shown in FIG. 7, is one means for supporting the thermal mat 5 during deployment, as recited in the claims.

Figure 8:
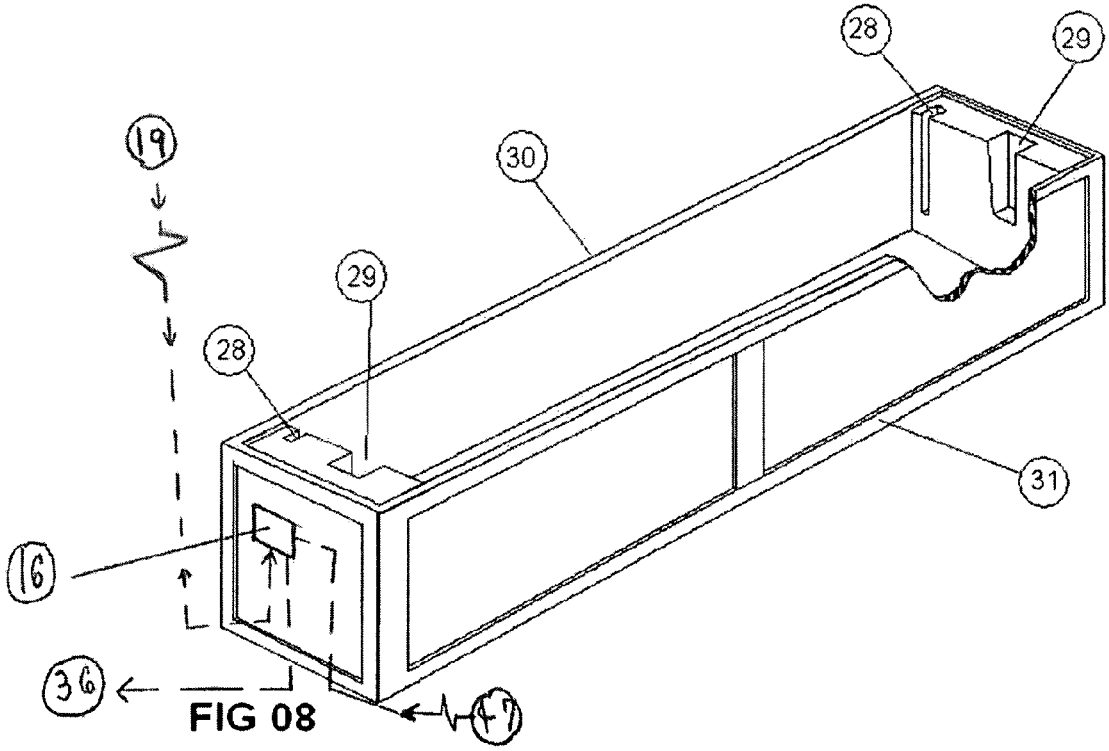
FIG. 8 illustrates the deployment system housing.

FIG. 8 shows an isometric view of the deployment system housing 30, which provides for both a thermal mat drive axle bushing and axle mounting slot 28 and a thermal mat spool axle bushing and axle mounting slot 29. This pre-selected arrangement allows for replacement of the entire thermal mat drive system via the cable drive axle assembly and thermal mat roller axle assembly 44, in FIG. 13, as a combined unit, similar to replacement of a printer cartridge in a printer. This arrangement reduces the effort necessary to maintain the deployment unit. The housing re-enforcement rib or support 31 ensures the deployment system housing 30 can support the forces generated in support and deployment of the thermal mat 5. The deployment system housing 30 shown in FIG. 8, is one means for storing the thermal mat deployment system 55, as recited in the claims.

Figure 9:
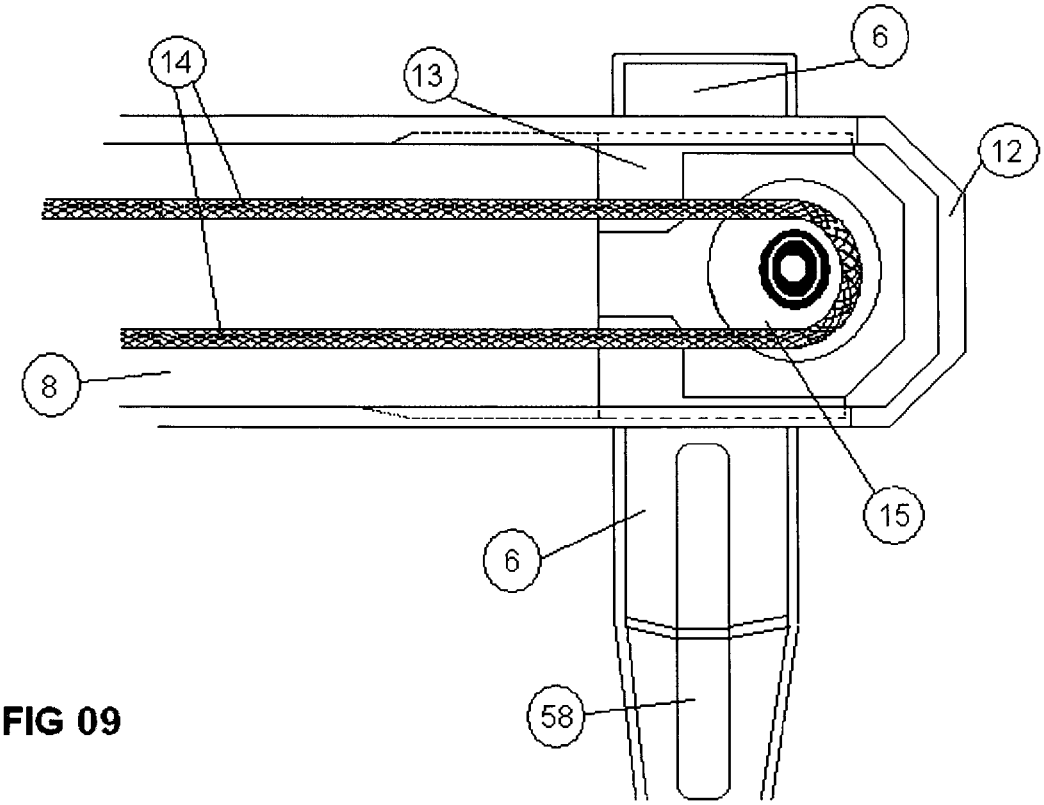
FIG. 9 illustrates a front view of the deployment system's cable adjustment assembly in combination with the anchoring and track and rail assembly.

FIG. 9 illustrates a front view of the deployment system's cable adjustment assembly in combination with the anchoring spike 6. The anchoring spike 6 supports the track and rail assembly 8 for deployment of the thermal mat 5. Baffle 58 provides a void in anchoring spike 6 which increasing stability of the anchoring spike 6 by maximizing available surface area and contact with the ground. Increasing the stability of the anchoring spike likewise increases the track and rail assembly 8 stability. The anchoring spike 6 shown in FIG. 9, is one means for attaching the track and rail assembly 8, as recited in the claims.

The track and rail assembly end cap 12 ensures thermal mat 5 cannot be deployed past the track and rail assembly 8. The idler block assembly 13 allows and supports the drive cable 14. Idler 15 provides a constant tension against the drive cable 14 to reduce and respond to variations in the drive cable 14 tensions while in operation.

Figure 10:
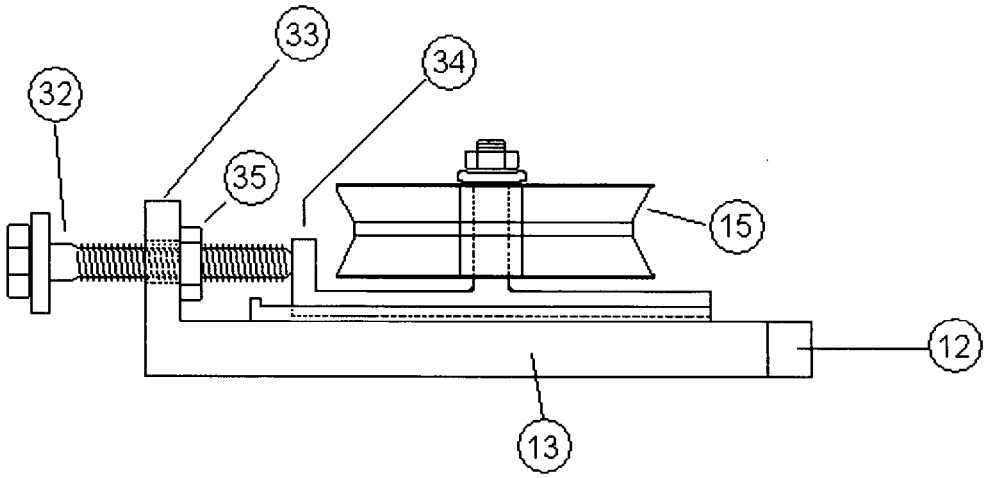
FIG. 10 illustrates a side view of the deployment system's stainless steel drive cable tension and idler block assembly.

FIG. 10 expands on and highlights FIG. 9 by providing a side view of the track & rail assembly end cap 12 from a horizontal perspective. Adjustment of the idler block assembly 13 and drive cable idler 15 increases or decreases the tension on the drive cable 14. Adjustment of the idler block assembly 13 is carried out by turning the threaded adjusting bolt 32 further into or out of the idler plate tongue 33, which supports the adjusting bolt 32. After adjustment and during operation, the drive cable idler stop foot 34 and adjusting bolt lock nut 35 together hold the idler block assembly in place. The idler block assembly 13 and drive cable idler shown in FIGS. 9 and 10 are one means for increasing or decreasing the cable tension, as recited in the claims.

Figure 11:
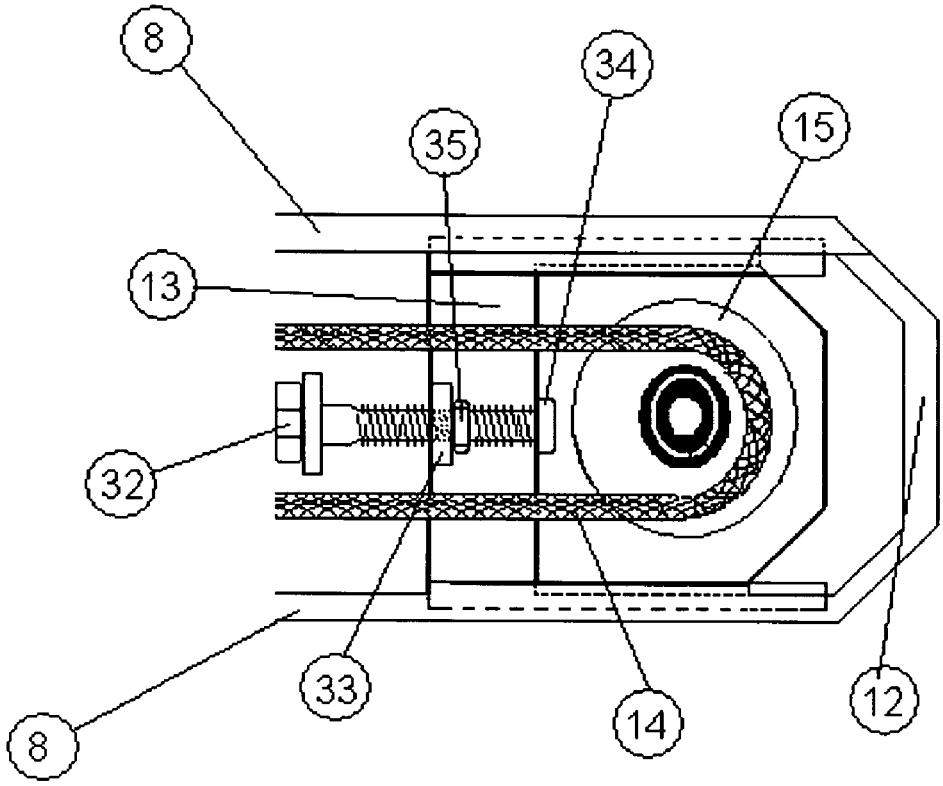
FIG. 11 illustrates a front view of the deployment system's stainless steel drive cable tension and idler block assembly in combination with the cable.

FIG. 11 illustrates a front view of the deployment system's stainless steel drive cable tension and idler block assembly in combination with drive cable 14. As in FIG. 10, adjustment of the idler block assembly 13 and drive cable idler 15 increases or decreases the tension on the drive cable 14. Adjustment of the idler block assembly 13 is carried out by turning the threaded adjusting bolt 32 further into or out of the idler plate tongue 33, which supports the adjusting bolt 32. After adjustment and during operation, the drive cable idler stop foot 34 and adjusting bolt lock nut 35 together hold the idler block assembly 13 in place. This assembly allows for adjustment over time as the drive cable 14 stretches and wears, by turning the adjusting bolt 32 to the right, screws in the adjusting bolt 32 pushing out the idler 15 thereby decreasing the slack in the drive cable 14. The adjusting bolt shown in FIG. 11, is one means for adjusting the drive cable 14, as recited in the claims.

Figure 12:
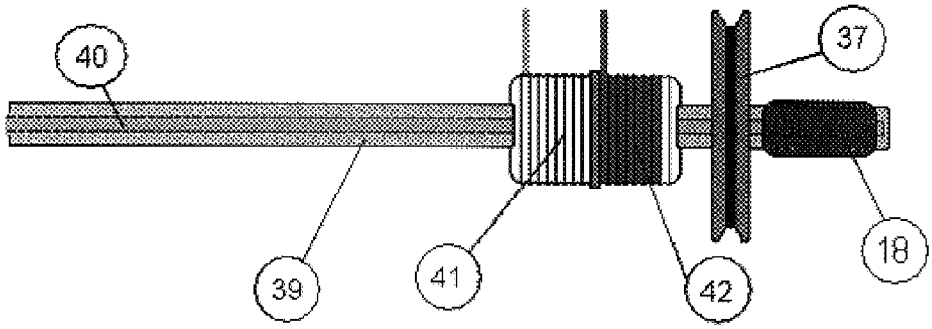
FIG. 12 presents a front view of the right side of the deployment system's powered drive axle.
Figure 13:
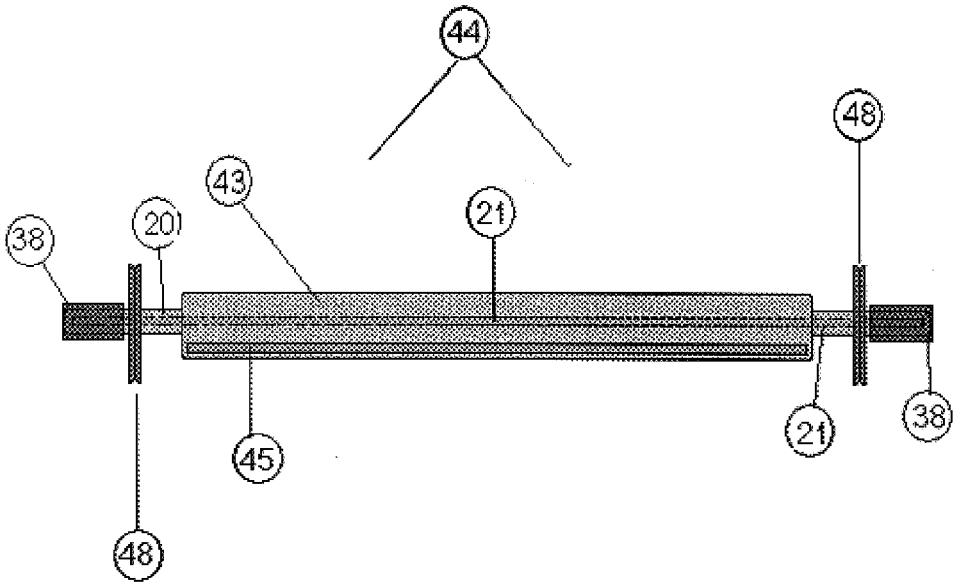
FIG. 13 presents a front view of the subcomponents making deployment system's drive axle and thermal mat spooler.

FIG. 12 presents a front view of the right side of the deployment system's powered drive axle 40 for the cable drive system and FIG. 13 presents a front view of the subcomponents making up the thermal mat deployment system's thermal mat roller system 84. These figures introduce the dual axle nature of the deployment system 55. The system as described and disclosed has a thermal mat roller system 84, in FIG. 29, and a cable drive system 85 for deployment of the thermal mat 5. The two systems work together to both unroll and deliver and then retrieve and roll the thermal mat 5 for storage in the system housing 30.

FIG. 12 highlights the drive system used to deliver the thermal mat 5. Drive shaft bushing 18 supports the drive shaft 40 in the deployment system housing 30. The drive shaft 40 is part of the cable based power drive system 85 that works in combination with the thermal mat roller system 84, which is not powered, to deploy the thermal mat 5. Deployment of the thermal mat 5 is powered and controlled by cable deployment spool assembly 41. Retraction of the thermal mat 5 is powered and controlled by cable retraction spool assembly 42. To reduce cable crossover common in many cable based drive systems, the disclosed invention employs a two-spool configuration. To reduce deterioration from exposure to ice and debris, the drive axle shaft 40 has a protective coating 39. Drive shaft drive pulley 37 delivers power from the cable drive system into the thermal mat roller axle assembly 44, in FIG. 13, to deploy the thermal mat 5 through a belt or chain drive connection to the thermal mat roller axle drive pulley 48. Those practiced in the arts will understand that the drive axle drive pulley 48 could also be a sprocket for a chain driven system or a gear for direct drive type system. Any and all of these types of mechanical power input are within the purview of the invention and herein claimed by the inventor. The drive system shown in FIG. 12, is one means for deploying the thermal mat 5, as recited in the claims.

FIG. 13 presents a front view of the subcomponents found in the thermal mat roller axle 21. The thermal mat roller axle 21 has a raised mat attachment core 43 to accommodate the bulkier nature of the thermal mat 5 and allows for a tight roll without requiring the stored thermal mat 5 to have such a small radius that the inner heating network may be damaged. The roller storage shaft bushing 38 supports the roller storage shaft 43 in the roller assembly. The thermal mat roller axle 21 has a core protective coating 20 and or covering. The roller axle 21 shown in FIG. 13, is one means for rolling and unrolling the thermal mat 5, as recited in the claims.

Figure 14:
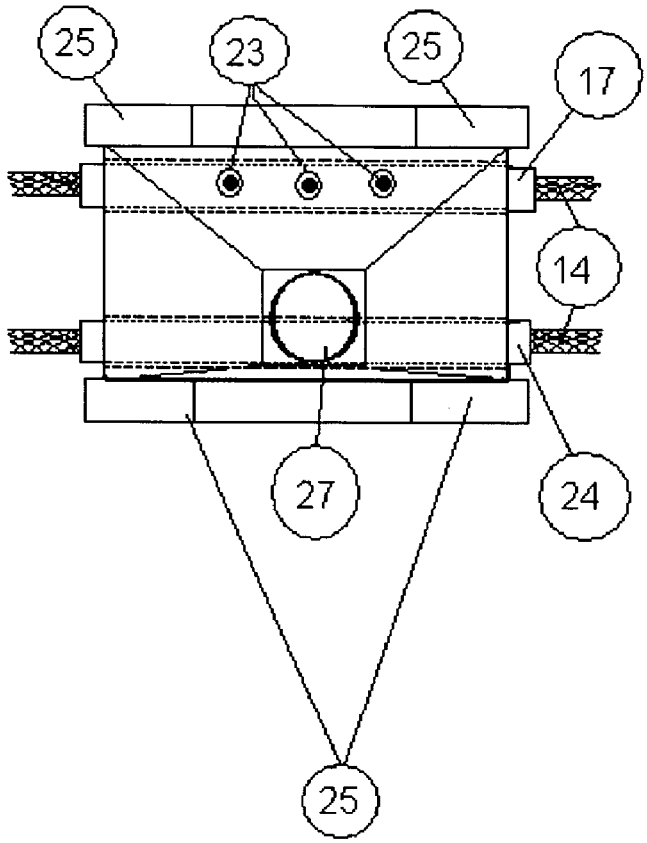
FIG. 14 presents a front view of the self-cleaning and clearing deployment cable block assembly and cable.
Figure 15:
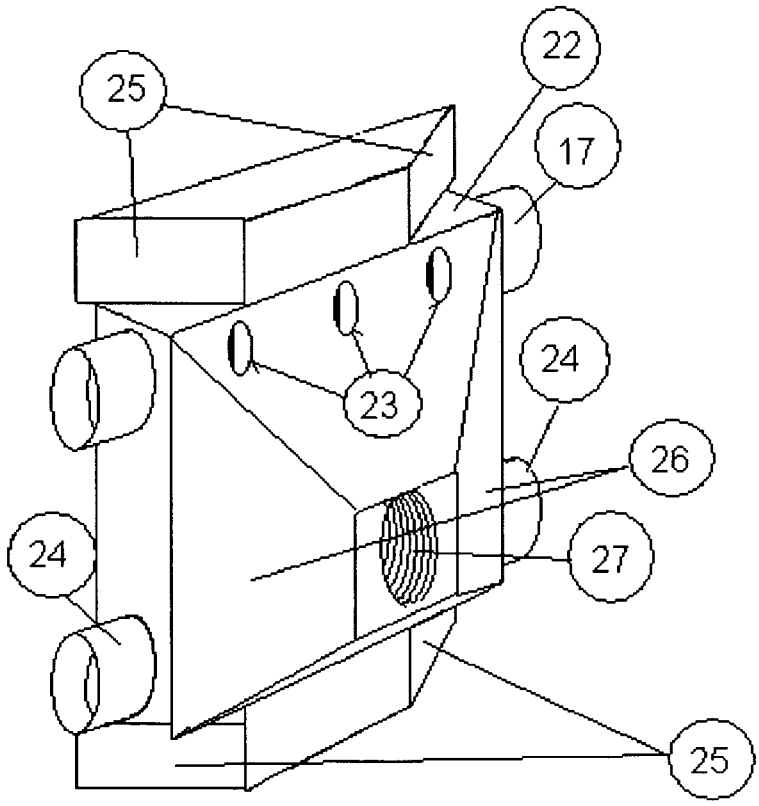
FIG. 15 presents a front perspective view of the self-cleaning and clearing deployment cable block assembly.

FIGS. 14 and 15 presents a side and front perspective view respectively, of the cable drive clamping tube assembly 22. As designed, this unit is self-clearing and self-cleaning. The key features of this assembly are the beveled cutting and scraping surfaces 25 to break ice and other debris that may form from time to time on the cable 14, and cable guide tube 17, which has a special adaptation to also act as a clamping device via compression screws 23 to secure the assembly shown in FIG. 14 to the deployment cable 14. Cable tube guide 24 has a dual action and function to both guide the cable 14 and to clearing and clean foreign material from the cable which may accumulate from time to time. Both tubes 17 and 24 are installed in the block assembly FIG. 14 by any means that would allow for a solid and secure fit so as to not allow movement of the tube inside the block assembly 22. One of the important connection points is 27 and is known as the thermal mat anchoring point. The thermal mat 5 is stretched between the track and rail assembly and connected on both side at the thermal mat anchoring point 27. The cable drive clamping tube assembly 22 as shown in FIG. 14, is one means for connecting the cable 14 to the thermal mat 5 as recited in the claims.

Figure 16:
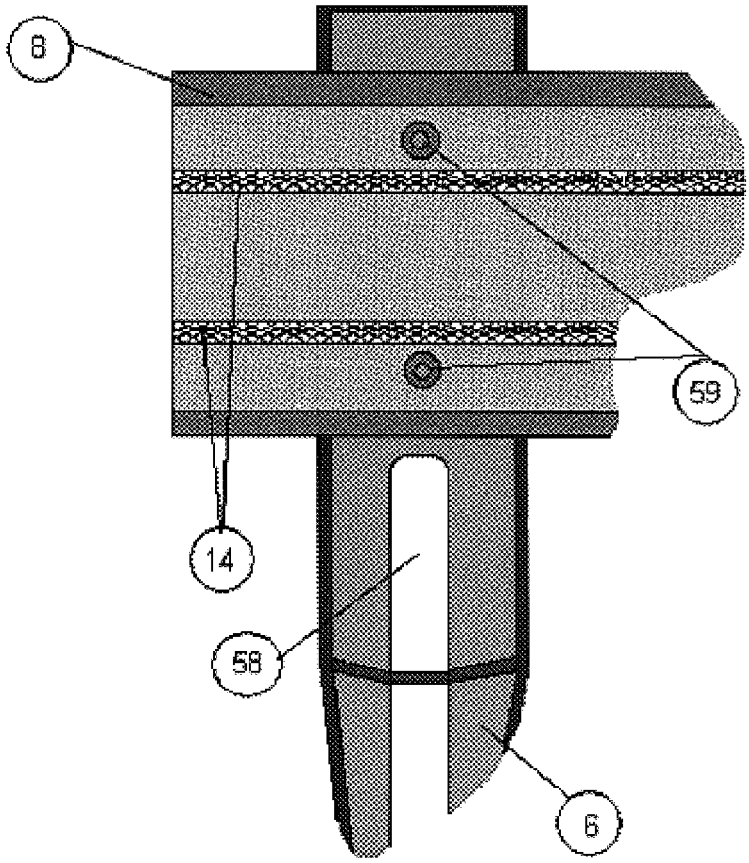
FIG. 16 presents a side view of the deployment system's track & rail assembly anchoring spike.

FIG. 16 presents the second front view of the track & rail assembly anchoring spike 6, track & rail assembly 8, and track & rail assembly anchoring spike fastener 59, anchoring spike stabilizing baffle 58 and drive cable 14. This combination allows for supporting and protecting cable 14 and it allows for the free but guided movement of the cable block assembly 22. The track and rail assembly 8 is one means for supporting the deployed thermal mat as recited in the claims.

Figure 17:
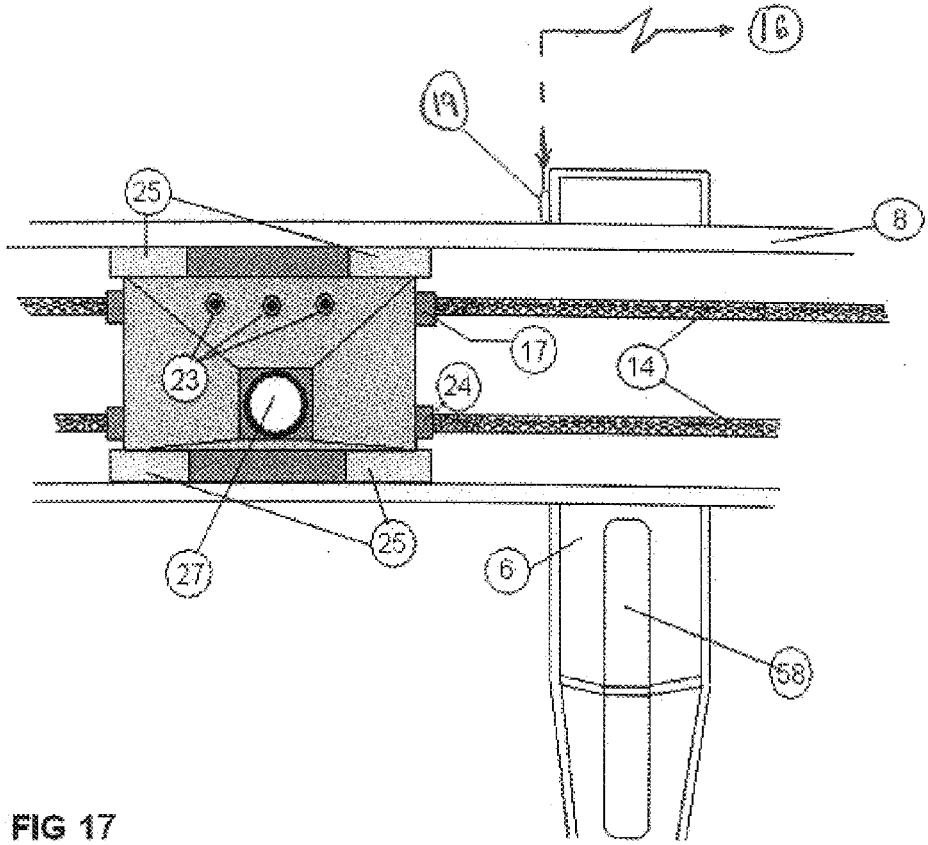
FIG. 17 presents a front view of the cable wedge assembly affixed to the rail assembly.
Figure 21:
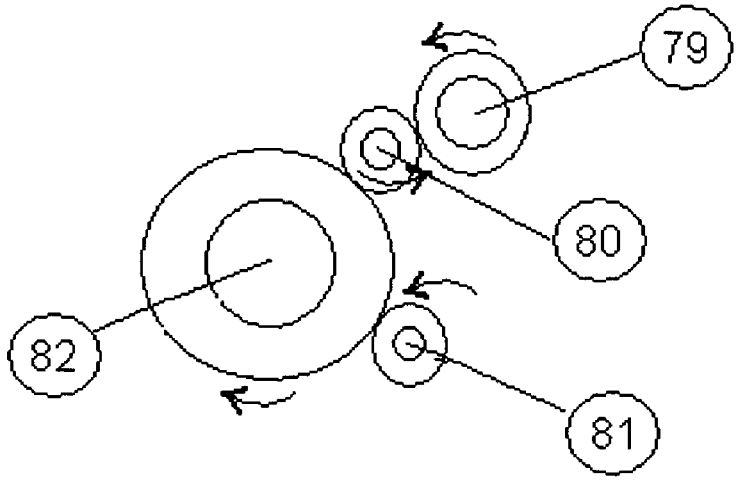
FIG. 21 presents a side view of the deployment system's drive and roller assemblies using a sprocket system for deployment of the flexible thermal material.
Figure 22:
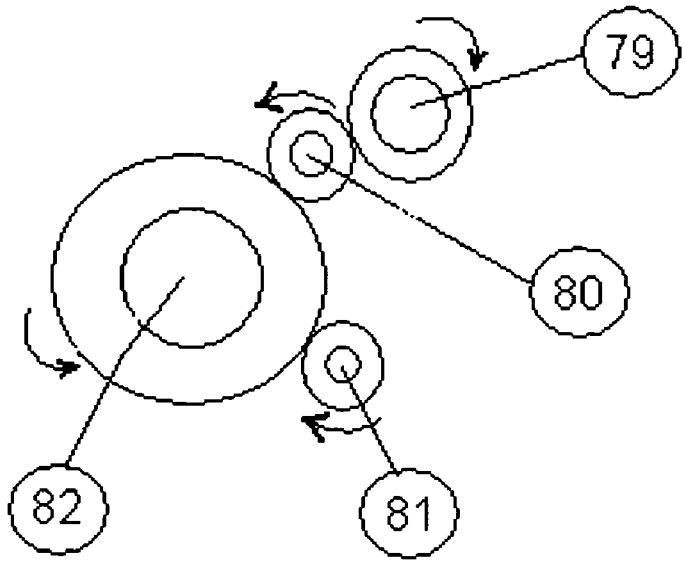
FIG. 22 presents a side view of the deployment system's drive and roller assemblies using a sprocket system for retraction of the flexible thermal material.

FIG. 17 illustrates the cable block assembly as mounted on the cable and in combination with the track and rail assembly 8 which make up the main elements of the rail system 82 as shown in more detail at FIGS. 21 and 22. This assembly is housed well within the protection of the track & rail assembly 8, which is secured to the support surface 2 by means of anchoring spike 6. Dependent upon the application, anchoring spike 6 can be altered or substituted to allow for attachment to non-earth type support surfaces such as a concrete or steel structure through various securement means including screws, bolts, adhesives, welding, brackets or a combination thereof.

Cable block assembly 21 is secured by the means of clamping tube assembly 17 and set screws 23 which are tracked by means of cable block assembly cable return tube and guide 24. The stabilizing baffle 58 of anchoring spike 6 helps to secure the spike because the organics may grow in and around the baffle area to fully support the anchoring spike 6 in the soil.

Figure 18:
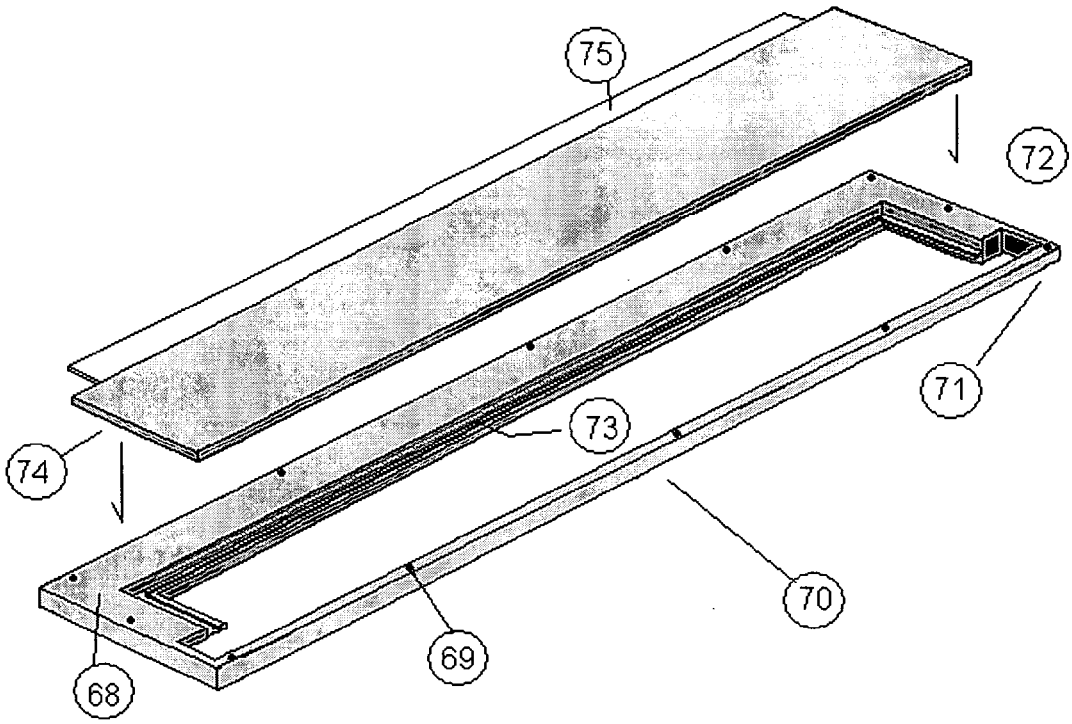
FIG. 18 presents a top perspective view of the deployment assembly's retractable cover and automatic hatch assembly.
Figure 19:
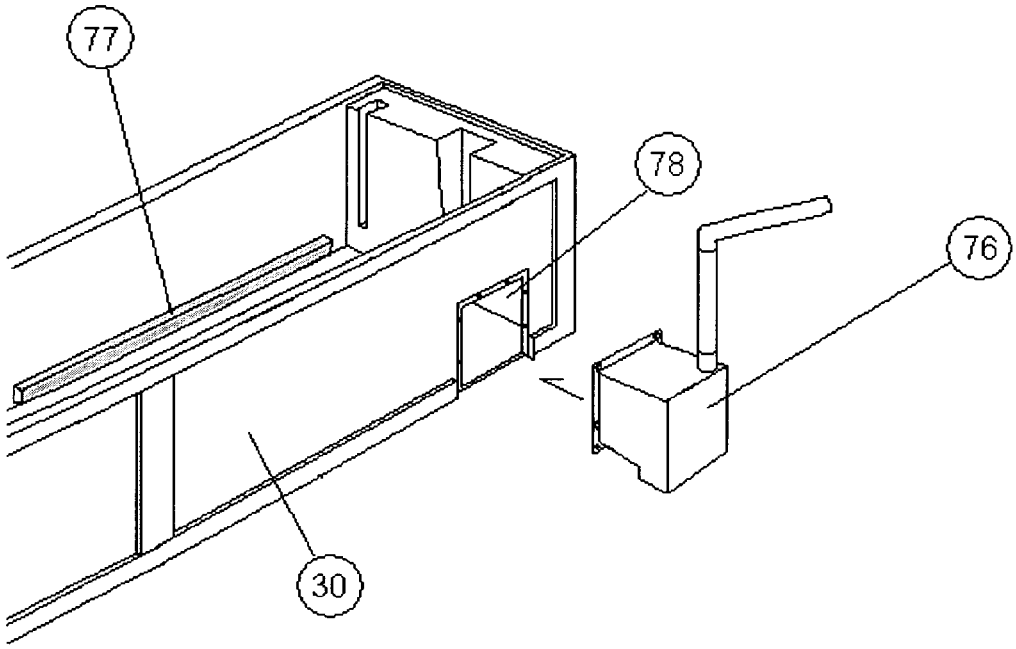
FIG. 19 presents a top view of the deployment system's sump assembly and retrofit.

FIG. 18 illustrates the retractable deployment cover 68 for the deployment system housing 30 top protection cover of the system. As designed, it may be driven over with a standard vehicle and will automatically open and close upon the deployment or retraction of the system. The top protection cover 68 contains the following elements including a retractable deployment cover 68 with an automatic hatch assembly 70. The retractable deployment cover 68 fits down on the rear of the housing via slip hinge 75 and fits down upon the front of the housing 30 by engaging with the fitting track and rail port 71 to fit over and against cover seal 73 to cover opening 72. Because the system is for the most part to be in place below grade, it is likely to be in contact and probably will attract subterranean moisture as well as water or ice collecting upon the cable 14 and the mat 5. As shown in FIG. 19, an appropriate way of dealing with this encroaching moisture as envisioned by the inventor is by the use of a sump type pump 76 via sump pump-mounting porthole 78 to remove the water entering and collecting in the waterproof and corrosion proof system housing 30. The deployment system housing 30 as shown is equipped with a ground fault interrupter (GFI) circuit type heater 77 to avoid freezing the deployment system 55. The deployment system housing is one means of storing the rolled thermal mat 5 as recited in the claims.

Figure 20:
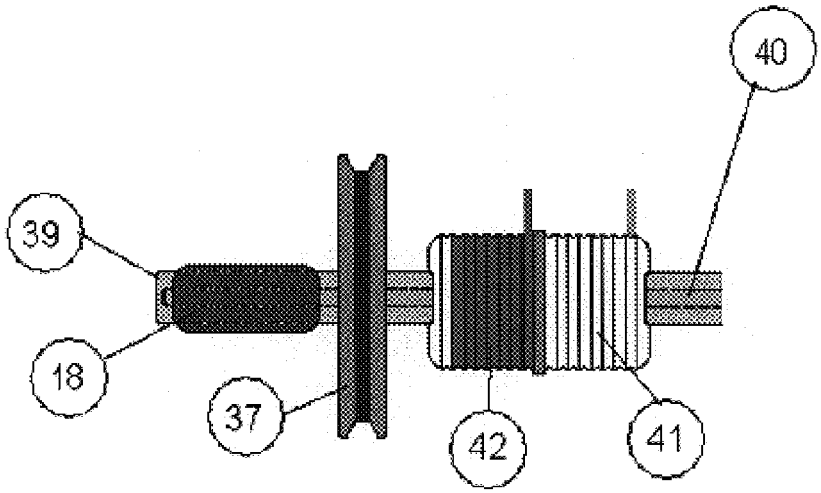
FIG. 20 presents a side view of the left side of the deployment system's cable deployment spool assembly and cable retraction spool assembly.

FIG. 20 demonstrates the utility of the deployment and retraction cable spooler system. The spool assembly is the same on both ends of the cable drive shaft 40 and consists of the following elements: a powered drive shaft drive pulley 37, a cable drive shaft bushing 18 and a center core support drive shaft 40 with protective coating 39. The cable deployment spool assembly 41 and the cable retraction spool assembly 42 are mounted to the cable drive shaft 40. This design ensures that as the cable 14 is spooled out by cable spool assembly 41, the cable is also reeled in by cable retraction spool assembly 42 thus maintaining sufficient tension on the cables 14 at all time. The cable deployment and retraction cable spooler is one means of deploying the thermal mat 5 as recited in the claims.

FIGS. 21 and 22 show the interconnectedness of the cable drive 85 and the mat roller systems 84. The figures present an end view of the main rotating parts for each system as if the drives were sprocket or gear based. As shown, the cable deployment driver 79 is rotated counter-clockwise for deployment of the cable 14. The cable deployment driver idler 80 in turn rotates clockwise. The mat deployment roller 82 then rotates in a clockwise direction for deployment of the thermal mat 5. To bring the thermal mat 5 back into the system housing 30 and roll the thermal mat 5 back onto the thermal mat roller 82, the cable deployment driver 79 rotates in a clockwise rotation for retraction of the thermal mat 5. The mat deployment driver idler 80 then turns counter-clockwise thereby driving the mat deployment roller idler 81 counter-clockwise turning the thermal mat roller counter-clockwise for retraction 82 and re-spooling. The cable drive 85 and the mat roller systems 84 as shown in FIGS. 21 and 22 are one means of rolling and unrolling the thermal mat 5 and one means of deploying and retracting the thermal mat 5.

Figure 23:
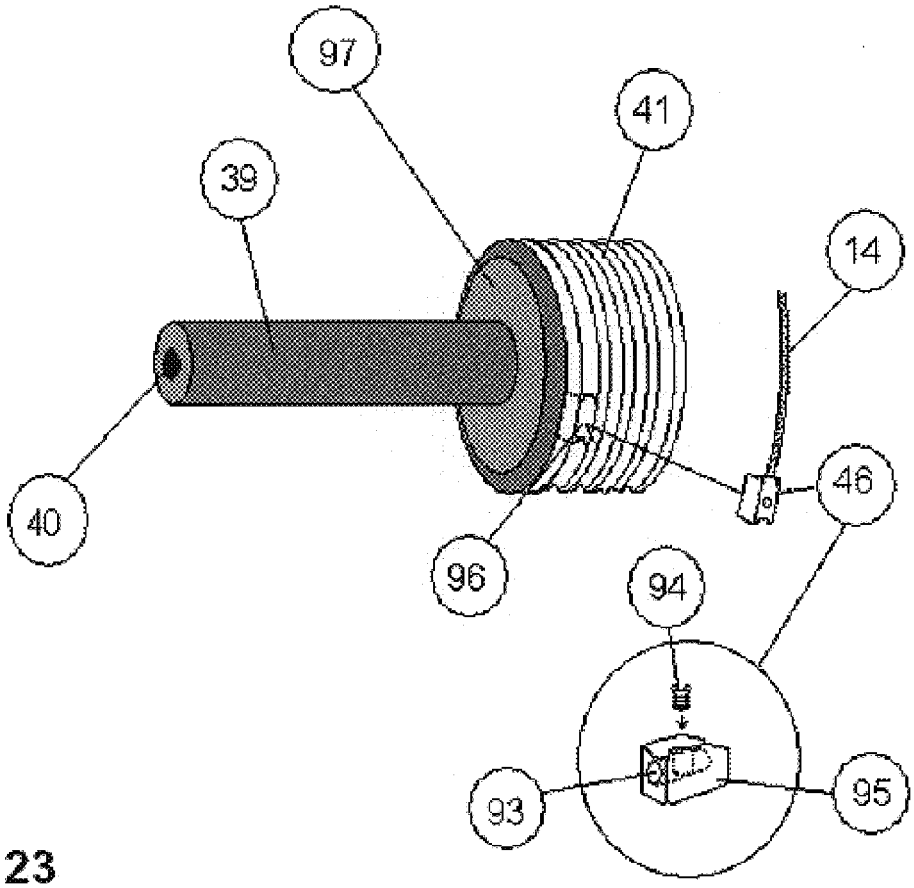
FIG. 23 presents a cable deployment spool assembly.

FIG. 23 shows the proper and unique way in which the cable are to be attached and secured into and on to the cable directional spool reel 97 using cable fastener attachment assembly 46. This assembly includes a drive cable 14 which may be made of stainless steel, steel, composite material and any other man-made material which provides a strong, corrosion resistant flexible connector. The powered drive shaft 40 with protective coating 39 is shown with cable deployment spool assembly 41. One end of the drive cable 14 should be inserted into the cable fastener attachment assembly 46 at cable wedge block cable portal 93 and secured into the cable wedge block assembly 95 by securing wedge port 96 and securing means 94 such as a set screw. Cable fastener attachment assembly 46 as shown in FIG. 23 is one means of fastening cable onto the cable spool reel 97.

Figure 24:
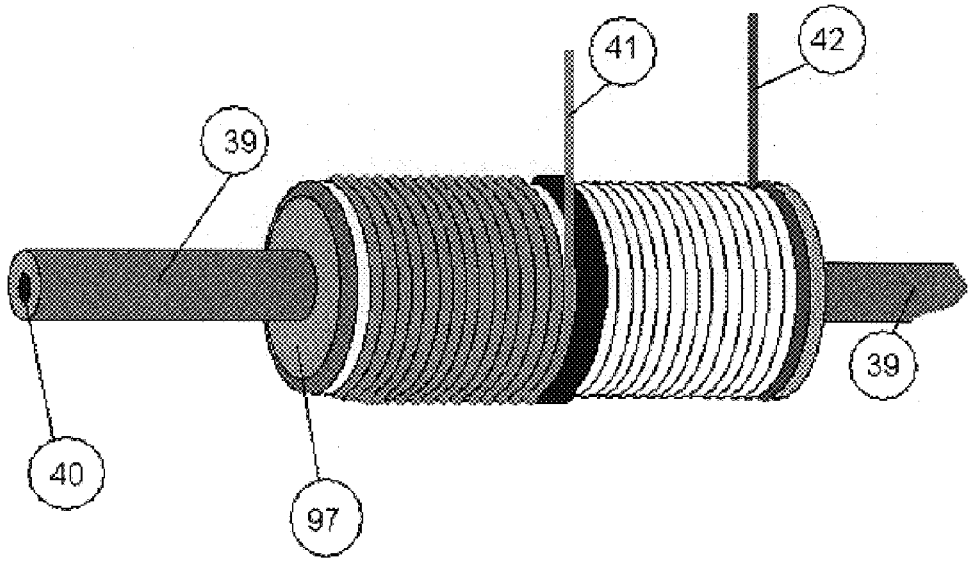
FIG. 24 presents a front view of the cable deployment and retraction spools as described and disclosed.

FIG. 24 illustrates the cable drive assembly with its powered cable drive shaft 40 with protective coating 39. As the cable drive shaft 40 turns in one direction, the cable deployment spool assembly 41 lets out or unrolls cable 14 from one end of the spool 97 while simultaneously the cable retraction spool assembly 42 brings in or rolls up the cable 14 onto the other end of spool 97.

Figure 25:
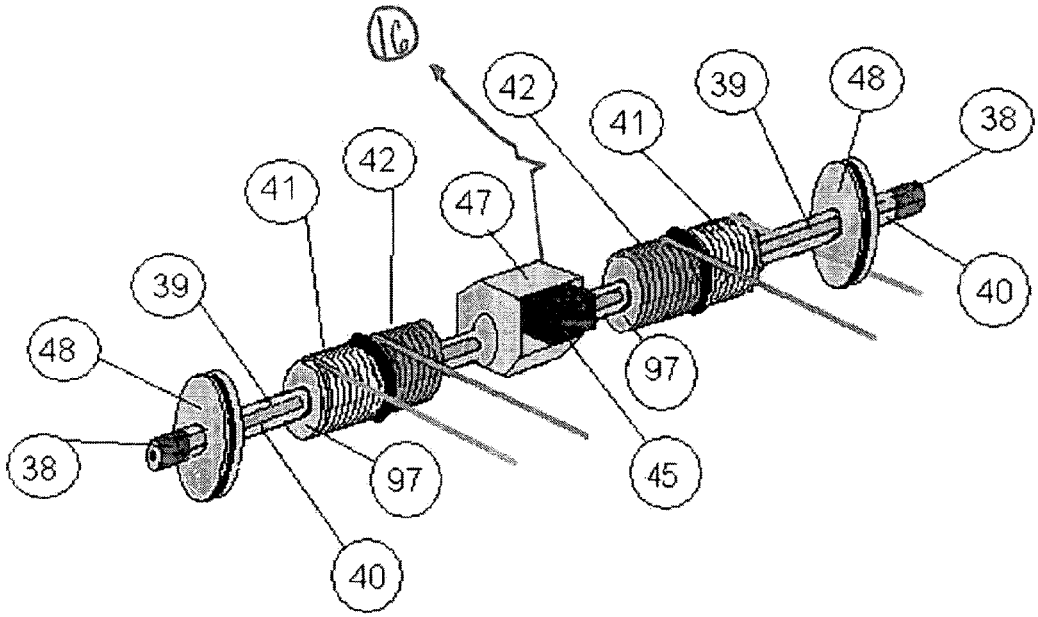
FIG. 25 presents a front view of the cable deployment and retraction systems in combination with deployment systems drive axle and drive motor.

FIG. 25 shows the cable drive system in its entirety and the major elements from working from the outside in are first the cable drive shaft bushings 38 which are located on the outer ends of powered cable drive shaft 40 having protective coating 39. Next, on the cable drive shaft 40 is the mat roller drive axle pulley 48 which provides power from the cable drive shaft 40 through a belt or chain (not shown) to the mat roller drive axle 21. The cable deployment spool assembly 41 and cable retraction spool assembly 42 work together to evenly pull the thermal mat 5 forward while the interconnection of the cable and thermal mat drive systems helps roll the thermal mat off the mat roller axle 21. This is accomplished with one dual directional water proof/submersible AC or DC voltage drive motor via the drive axle. Also as shown at 47, the drive motor 45 is provided with a child guard safety torque sensor 47 to automatically stop deployment in the event a person becomes entangled with the thermal mat deployment system.

Figure 26:
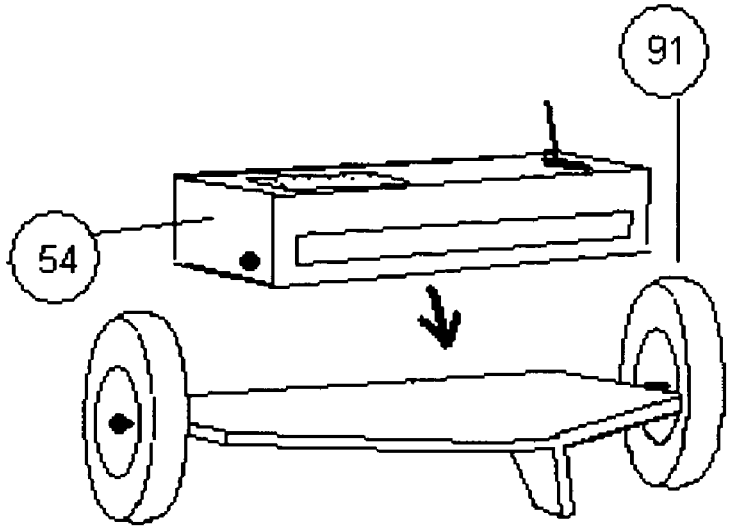
FIG. 26 presents a front view of the deployment system's housing in a portable configuration.

FIG. 26 shows the versatility of the described and disclosed design and demonstrates the portability of this inventive design. The invention may be deployed as a portable configuration assembly 54 and moved between deployment areas and storage facilities by portable configuration assembly travel cart 91.

Figure 27:
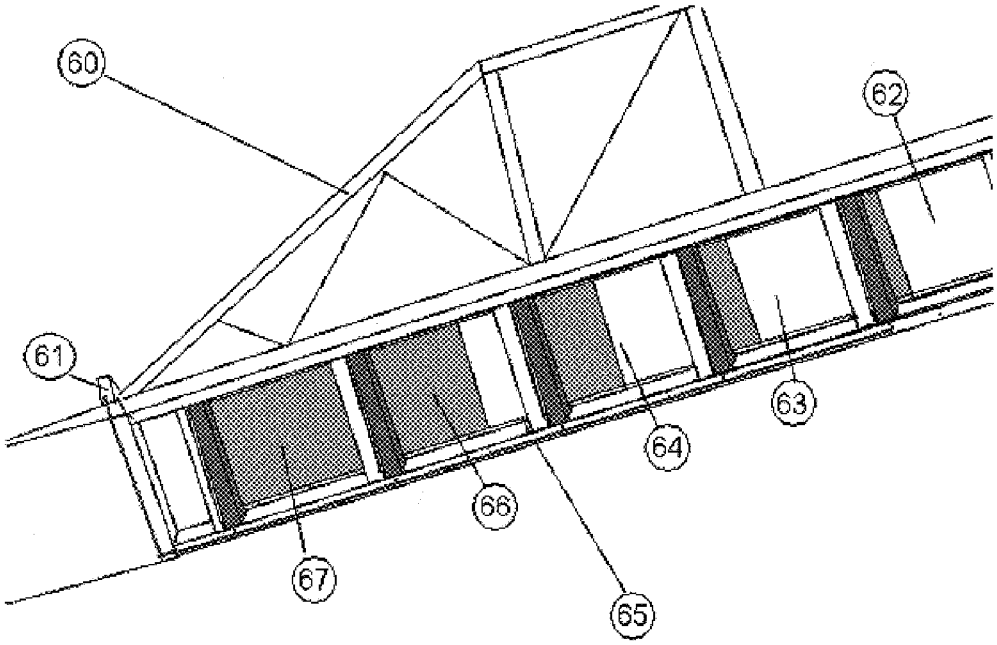
FIG. 27 presents another application for autonomous deployment system in combination with the underside of a bridge.

FIG. 27 demonstrates another embodiment of the present invention as placed on a bridge. Even though the preferred embodiment of the invention is for placement in a subterranean manner, this embodiment demonstrates the functionality to be used as a deployable underlayment. The main elements in this figure are the thermal mat retrofit to bridge application with multiple installations 60, a cotroller box for system control. As shown, the retrofit to the bridge is shown ⅛ deployed 62, ¼ deployed 63 and ½ deployed 64. As shown the retrofit to bridge application is ¾ deployed 66 and fully deployed 67. All of the deployment systems as shown are connected and wired in such a way as to deploy at the same time.

Figure 28:
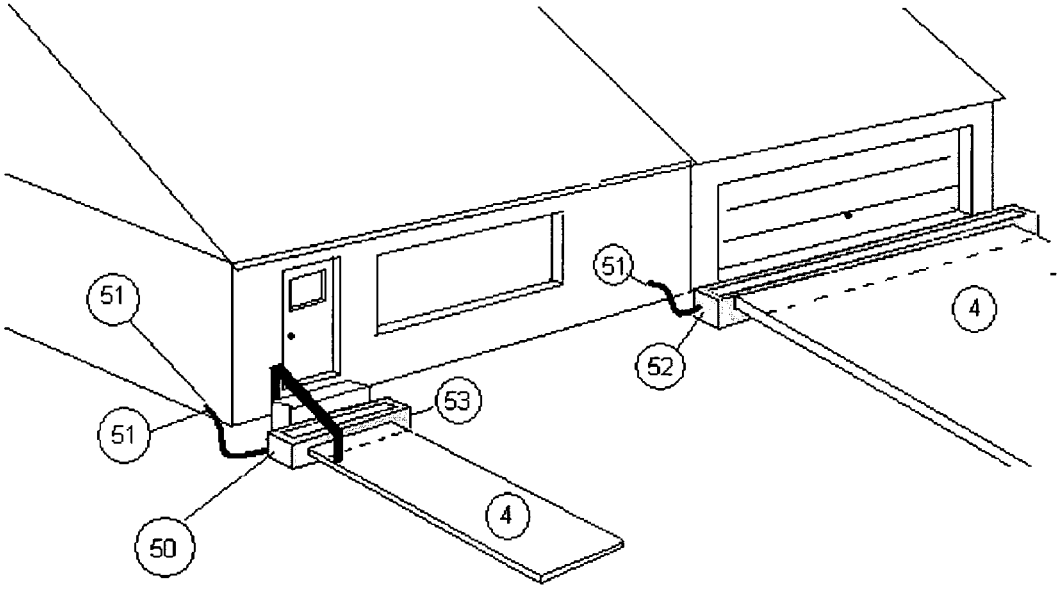
FIG. 28 presents another embodiment wherein the deployment system and housing may be submerged or flush with the top surface of the driveway or replaces a step in a set of stairs.

FIG. 28 demonstrates that a partial sub-terrain placement can replace a normal step or be placed flush with any surface level needed. As shown the pre-existing driveway or area to be treated 4 is located in close proximity to a building and or structure 1. Portable configuration assembly towing clamp or lock 50 secures the assembly to the treatment area 4. As shown on the left side of the figure, the configuration has been installed in its semi-submerged configuration 53 wherein the deployment system is configured to allow it to become a part of the step or raised platform 53. By comparison, the deployment system shown on the right side of the figure is configured for installation in its fully submerged configuration 52 which allows the configuration to be driven on or walked over.

Figure 29:
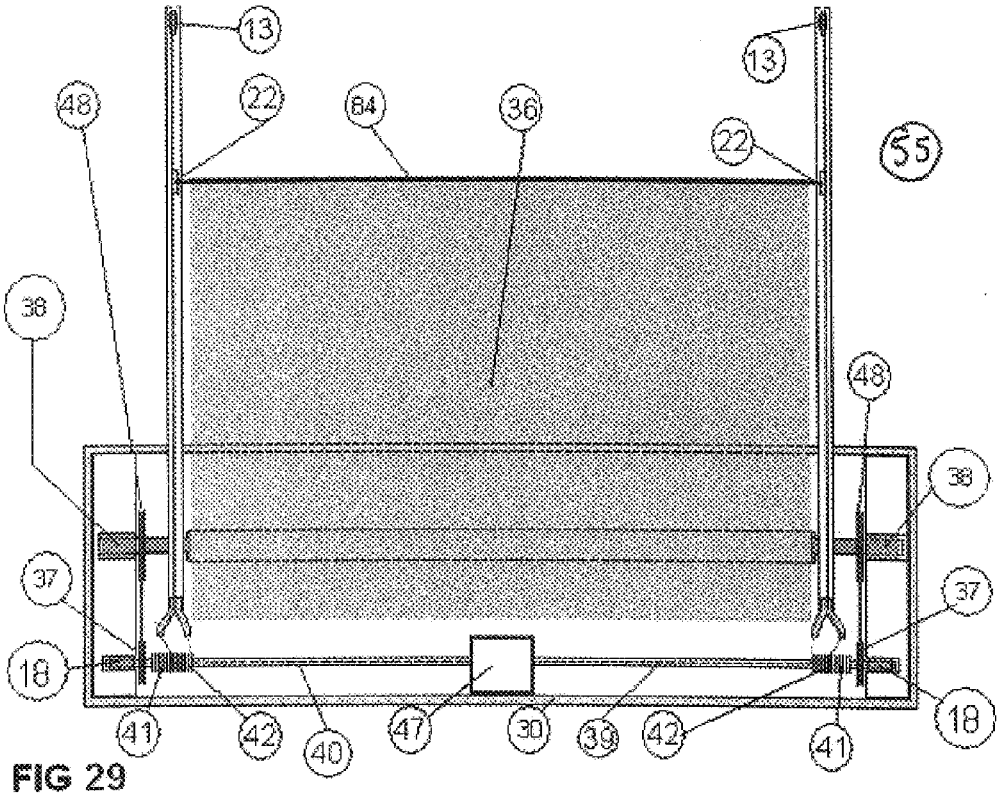
FIG. 29 presents a top overview of the unit deployed and in place.

FIG. 29 presents a top overview of the deployment unit for thermal radiating materials deployed and in place. The subsystems making up the deployment system 55 are each clean and easily definable. The three interconnected subcomponent systems of the thermal mat deployment system 55 disclosed herein are the rail system 83, the mat roller system 84 and the cable driven mat deployment system 85. The thermal mat 5 is guided for deployment onto or above the treatment area 4 by the mounted track and rail system 83 shown from the top and as shown by opposing rails 8. The thermal mat 36 is positioned onto and above the treatment area through interaction of both the thermal mat roller system 84 and mat deployment system 85. The sub-systems are interconnected to accomplish the common objective of mat deployment and to allow one AC or DC voltage drive motor 47 energized by powered source 49 in combination with dual directional drive shaft 40 to power both the mat deployment system 85 and the mat roller system 84. The drive motor 47 should be waterproof or fit for submersible service.

As shown the thermal mat 36 is rolled onto and off of the thermal mat roller system 84 through the dual directional drive shaft 40 having a protective coating 39 to prevent component deterioration from exposure to ice, grime, salt, sand and water common for this type of service. The thermal mat 36 is deployed or rolled off when the thermal mat roller axle 20 is turned by the thermal mat roller axle drive pulley (or sprocket) 48 which is turned through power connected to a belt (or chain) connected to the powered drive shaft pulley (or drive gear) 37 fixed on both ends of the dual directional drive shaft 40 which also has bushings 18 placed at both ends of the drive shaft 40. The drive cable 14 is looped through the track and rail 8 on each side of the thermal mat 5 by the idler block assembly 13 to maintain continuous tension on the drive cable 14 as cable spooler 41 turns to let out cable and cable retractor 42 works to bring it in, thus supporting the drive cable 14. As arranged, the system allows for versatility in both the mat rolling system 84 and the mat deployment system 85. Idler 15 provides a constant tension against the drive cable 14 to reduce and respond to variations in the drive cable 14 tensions while in operation.

Figure 30:
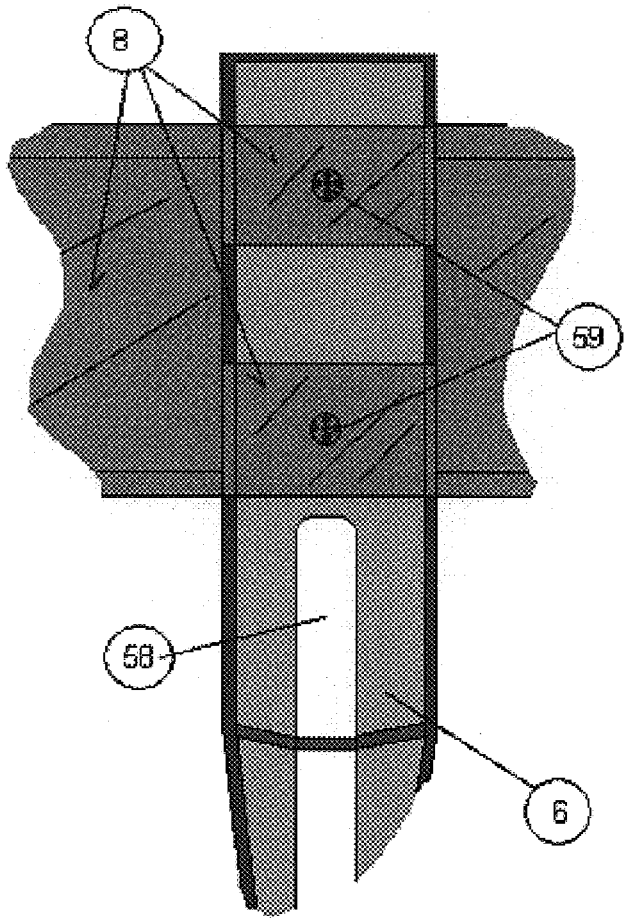
FIG. 30 presents a back view of the anchoring spike for the track and rail assembly.

FIG. 30 highlights the importance of how the track and rail assembly 8 are secured and mounted in place along the surface area to be treated using track & rail assembly anchoring spike 6. This spike 6 allows for a secure mounting of the track and rail assembly 8 through fastener 59. The unique configuration of anchoring spike 6 and placement within in the spike of the baffle area 58 creates stabilization of the anchoring spike 6 and thus the track and rail assembly 8.

Figure 31:
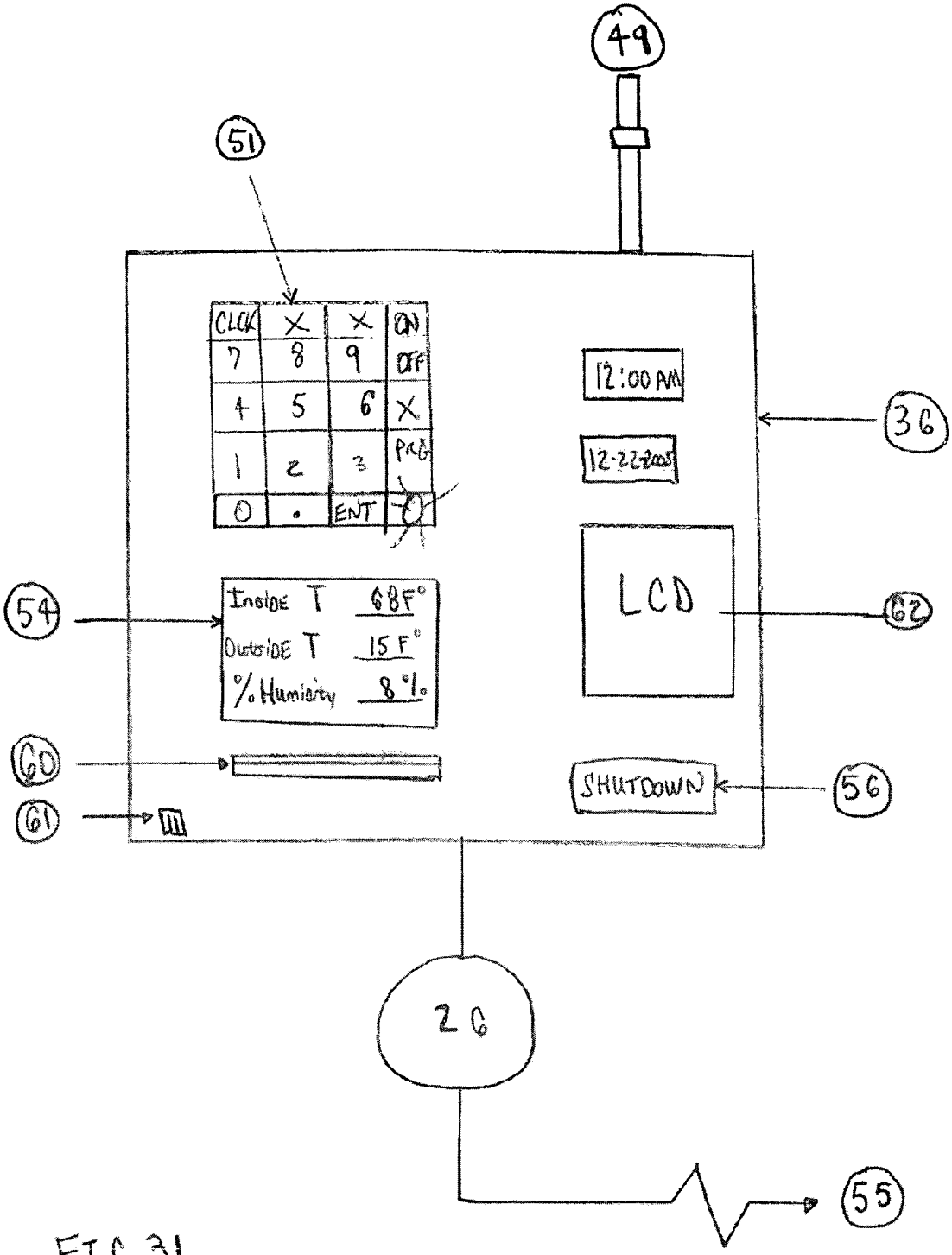
FIG. 31 presents a simplified view of the control system and panel.

FIG. 31 illustrates the data input and control aspects of the deployment system 55. The control panel 36 can be mounted upon the deployment system 55 or in close proximity to the deployment system 55, such as in a garage adjacent a driveway surface 4. In larger commercial applications, such as a parking lot, commercial building roof or bridge, it may be necessary to mount the control panel further from the deployment system 55 and include a video feed from environment sensors 19 viewable from LCD 62 mounted on or adjacent the deployment system at and or through control panel 36. Environmental conditions monitored by the environment sensors 19 may include but are not limited to temperature, barometric pressure, humidity and the physicial surroundings of the deployment system 55.

As shown in FIG. 31, this information can be displayed on control panel 36 at sensor indicator panel 54. One way to configure the sensors 19 mounted on or adjacent the deployment system 55 would be through a sensor pod 16. The sensor pod 16 as mounted to the deployment system 55 could collect the data for transmission to the control panel 36 for review by human users at the sensor indicator panel 54 and or use in programmable logic controller 26 embedded therein. Communications between both the environment sensors 19 and the torque guard sensor 47 to the control panel 36 could also be configured wirelessly using readily available technology, in which case sensor pod 16 may not be necessary for data collection from the deployment system 55.

The controls system for the deployment system 55 may also be configured for manual input through data input panel 51 for direct human user interface through any number of configurations. Data input panel 51 in combination with either a programmable logic controller 26 or a chip and microprocessor, may be configured to track both the time and date to allow the user improved control of the deployment system 55 to ensure the deployment system does not deploy at potentially high traffic times. Additionally, the control panel may be configured with power switch, shown in combination with 51, and an emergency shutdown switch 56 for immediate shutdown of the system without de-energizing control panel. The control system for the deployment system 55 may also be configured for external communication through a multitude of data ports. Access from the Internet through phone port 61 for wired access or PCMCIA Ethernet card slot 60 for wireless access, or any similar types of configurations could be added. The sensor display 54, control panel 36 and data ports as shown in FIG. 31 one means of sensing, controlling and communicating with the apparatus recited in the claims.

While the invention has been described with reference to preferred embodiments, variations or modifications would be apparent to one of ordinary skill in the art without departing from the scope of the invention. Consequently, the appended claims should not be limited to their literal terms, but should be broadly construed in accordance with the scope of the invention, as described above.

The invention claimed is:

1. An apparatus using a flexible thermal material for removing and minimizing the collection of ice and snow upon a surface comprising:

a. A power source;

b. A thermal mat having a flexible conductive body and surface, said thermal mat being connected to said power source and having the capacity to transfer energy to an absorbing surface which is in direct contact with, or close proximity to, said conductive surface of said thermal mat, upon being energized by said power source, to remove and minimize ice and snow collection;

c. A rolling system for rolling said thermal mat into itself, therein forming a tubular arrangement having an outer diameter sufficient to avoid damage to the thermal mat conductive body or surfaces;

d. A storage system, having sufficient size to enclose within, said tubularly arranged thermal mat, without damage to said thermal mat conductive body or surfaces;

e. An unrolling system engaged with said storage system, for unwinding said tubularly arranged thermal mat;

f. A deployed mat support system engaged with said mat unrolling system; said deployed mat support system allowing said unrolling system to force said thermal mat, as guided by said deployed mat support system, over said absorbing surface for energy transfer between said conductive surfaces and said absorbing surfaces of said thermal mat; and, g. A mat retraction system engaged with said deployed mat support system, to allow said thermal mat to be directed away from said absorbing surface; wherein said mat retraction system is also engaged with said rolling system for rolling said thermal mat into itself to reform a tubular arrangement for re-insertion within said storage system and wherein said rolling, storage, unrolling, deployment and retraction systems are also connected to said power source.

2. An apparatus as described in claim 1 having independent power sources for connection to said systems.

3. An apparatus as described in claim 1 having a single bi-directional motor to drive said systems.

4. An apparatus as described in claim 3 having a common drive system to power said rolling, unrolling, deployed mat support and retraction systems.

5. An apparatus as described in claim 4 wherein said systems are arranged to allow said bi-directional motor to deploy said thermal mat when said bi-directional motor turns in a first direction and to retract said thermal mat when said bi-directional motor turns in a second direction.

6. An apparatus as described in claim 1 including an environmental sensor system.

7. An apparatus as described in claim 4 including a programmable system for control.

8. An apparatus as described in claim 5 including an external data input port.

9. An apparatus as described in claim 6 including a connection to the Internet.

10. An apparatus as described in claim 6 wherein said environmental sensors include one of the following:

a. The temperature of the environment surrounding the apparatus; or, b. The atmospheric barometric pressure surrounding the apparatus; or, c. The percent humidity surrounding the apparatus; or, d. The percent precipitation of the environment surrounding the apparatus; or, e. A visual image of the environment surroundings.

11. An apparatus as described in claim 7 wherein said programmable system for control uses data including one of the following:

a. The time; or, b. The date; or, c. User directions to override initiation of said flexible thermal material; or, d. User directions to override retraction of said flexible thermal material.

e. User directions to power down the system.

12. An apparatus as described in claim 1 wherein deployed mat system is a track and rail assembly placed on opposite sides of said thermal mat, parallel with the direction of said thermal mat deployment.

13. An apparatus as described in claim 10 wherein said track and rail assembly is attached to the support surface by an anchoring spike having a void.

14. An apparatus as described in claim 11 wherein said track and rail assembly is attached to the support surface by an anchoring spike having a void.

15. An apparatus as described in claim 4 having a cable in communication with said unrolling system to pull said thermal mat through said deployed thermal mat support system during deployment; said cable also in communication with said rolling system to retract said thermal mat through said deployed thermal mat support system during retraction.

16. An apparatus as described in claim 4 having a cable drive shaft, said cable drive shaft having a first and second cable spool at each end of said cable drive shaft, as said cable drive shaft is turned in a first direction for deployment of said thermal mat, said first cable spools unwind cable off said first cable spools to allow deployment of said thermal mat, concurrently said second cable spools wind cable onto said second cable spools thereby maintaining tension on said first and second cables for deployment of said thermal mat, thereafter turning said cable drive shaft in said second direction for retraction of said thermal mat, said first cable spools winding cable onto said first cable spools and concurrently said second cable spools unwind cable onto said cable from said second cable spools.

17. An apparatus as described in claim 16 having rolling and unrolling systems with drive systems integrated with said cable drives.

18. An apparatus as described in claim 4 wherein said systems are arranged to allow said bi-directional motor to deploy said thermal mat when said bi-directional motor turns in a first direction and to retract said thermal mat when said bi-directional motor turns in a second direction.

19. An apparatus as described in claim 10, wherein means are employed to remove ice collected upon said apparatus during retraction of said flexible thermal material from said deployment surface.

20. An apparatus as described in claim 12, wherein means are employed to remove ice collected upon said deployed mat support system during retraction of said thermal mat from said absorbing surface.

21. An apparatus as described in claim 1 wherein said deployment surface is a building roof.

22. An apparatus as described in claim 1 wherein said deployment surface is a bridge.

23. An apparatus as described in claim 1 wherein said deployment surface is a driveway.

24. An apparatus as described in claim 1 wherein said deployment surface is a parking lot.

25. An apparatus for deploying a flexible thermal material for removing ice and snow from a surface and minimizing collection of ice and snow upon a surface including:

a. A power means;

b. A thermal mat means having a flexible conductive body and surface, said thermal mat means being connected to said power means, and having the capacity to transfer energy to an absorbing surface which is in direct contact with, or close proximity to, said conductive surface of said thermal mat, upon being energized by said power source, to remove and minimize ice and snow collection;

c. A rolling means for rolling said thermal mat into itself, therein forming a tubular arrangement having an outer diameter sufficient to avoid damage to the thermal mat conductive body or surfaces;

d. A storage means, having sufficient size to enclose within said storage means, said tubularly arranged thermal mat, without damage to said thermal mat conductive body or surfaces;

e. An unrolling means, engaged with said storage means, for unwinding said tubularly arranged thermal mat;

f. A deployed thermal mat support means; said deployed mat support means allowing said mat to be deployed over said absorbing surface for energy transfer between said conductive surfaces of said thermal mat and said absorbing surfaces; and, g. A mat retraction means allowing said thermal mat to be retracted from said absorbing surface;

h. wherein said mat retraction means is also engaged with said rolling means for rolling said thermal mat into itself to re-form a tubular arrangement for re-insertion within said storage means and wherein said rolling, storage, unrolling, deployment and retraction means are also powered.

26. An apparatus as described in claim 25 including sensing means which sense, collect and communicate data representing environmental conditions surrounding said apparatus to said apparatus.

27. An apparatus as described in claim 26 including a communication and control means allowing data input exclusive of sensing means and selection of a control range for directing operation of said apparatus.

28. An apparatus as described in claim 27 wherein said communication and control means includes a comparator means for comparing data collected by the sensing means with data input to for controlling said apparatus.

* * * * *